United States Patent [19]

Hecht et al.

[11] Patent Number: 4,542,860

[45] Date of Patent: Sep. 24, 1985

[54] HUB LOCK FOR COIL FORMER SUPPORT MEANS

[75] Inventors: Richard M. Hecht, Chicago; Robert G. Seaverns, Northbrook, both of Ill.

[73] Assignee: Gasway Corporation, Chicago, Ill.

[21] Appl. No.: 506,300

[22] Filed: Jun. 21, 1983

[51] Int. Cl.[4] ..... B65H 75/02

[52] U.S. Cl. ..... 242/72 R; 242/68.1

[58] Field of Search ..... 242/72 R, 72.1, 68.3, 242/68.4, 81, 68.2, 68.1; 279/2 A

[56] References Cited

U.S. PATENT DOCUMENTS

| | | | |
|---|---|---|---|
| 355,145 | 12/1886 | Davis et al. | 242/68.6 |
| 1,878,264 | 9/1932 | Claybourn | 242/72 |
| 2,491,917 | 12/1949 | Brovwer et al. | 242/68.6 |
| 2,638,282 | 5/1953 | Prevost | 242/72 |
| 2,949,313 | 8/1960 | Moser et al. | 279/2 A X |
| 3,086,783 | 8/1960 | Kelso | 279/2 A X |
| 3,780,962 | 12/1973 | Sykora | 242/72 |
| 3,865,326 | 2/1975 | Beaudoin | 242/68.6 |
| 3,989,202 | 11/1976 | Noe et al. | 242/72 R |
| 4,147,310 | 4/1979 | Harden et al. | 242/81 X |
| 4,422,590 | 12/1983 | Rathbone | 242/72 R |

*Primary Examiner*—Stephen Marcus
*Assistant Examiner*—Leo J. Peters
*Attorney, Agent, or Firm*—Laff, Whitesel, Conte & Saret

[57] ABSTRACT

A hub lock for a coil forming machine has a spindle with a shaft telescopingly mounted within a tube that is concentric thereto. A metal part somewhat in the form of a top hat is positioned over an end of the tube. A resilient elastomer block is on the crown and abutting against the brim of said top hat shape. A pressure plate on the end of the shaft squeezes the elastomeric block so that it is pressed against the interior of a hole in a wheel fitted over the block.

7 Claims, 6 Drawing Figures

HUB LOCK FOR COIL FORMER SUPPORT MEANS

Reference is made to my copending application entitled COIL WINDING CONTROL GUIDE, U.S. Ser. No. 506,301, filed June 21, 1983, which shows another aspect of the same system.

This invention relates to machines for winding a web of ribbon-like metal into coils, in order to provide a supply of coated metal stock that may later be used during future manufacture, and more particularly, to a hub lock for holding the coil in place.

Stock metal coating is a modern, high speed production process for applying smooth films of lacquers, paints, varnishes, adhesives, strippable films or almost any other coating material to work pieces, which are flat or moderately curved. It uses a flow coating principle of passing a work piece through a continuous falling stream of liquid coating material, which is accurately controlled in thickness and rate of flow so that there is no excess runoff.

The surface of a work piece passing through the process is coated uniformly and continuously, piece after piece, at high production rates. This is accomplished by flowing a uniformly distributed coating material over a weir or dam. The coating material then drops under gravity from a skirt of the weir, either onto the work piece or into a gutter which returns the coating material to the reservoir to be recirculated.

An example of such a machine is one for coating a ribbon-like web which is later used in further manufacture of the slats of a venetian blind. A rolling mill, or the like, produces a long and continuous ribbon of metal which is wound upon a spindle to form a supply reel. That suppy reel may then be transferred to any other suitable machine for further processing, in this case for applying a surface coating. After the coating, any suitable further manufacturing steps may be carried out. For example, a coil of coated venetian blind slat stock may be cut off the coated coil at any discrete length, and punched to provide openings for enabling a passage of the venetian blind control ropes.

The problems with coiling coated metal stock of this type relate to a need for preserving an unmarred surface on the coating material at a time when the coating has not yet necessarily had time for complete curing. Thus, for example, if the slat stock is spray painted, it may be dry to the touch; however, there could still be enough solvents in the "dry" paint to migrate from turn to turn within the coil and combine to prevent an unwinding of the coil which leaves an unmarred surface. Other problems could also occur such as surface scratching if successive turns of the coil are cinch up tightly or if they are so loose that they rub over each other within the coil.

Therefore, there is a need to guide the coated ribbon stock onto the coil and to keep the successive turns in alignment. As the successive turns are laid down, each adds some degree of radial tension within the coil. The tension of all of the successive turns are additive so that the center coil tends to cinch-up tighter and tighter as the diameter of the coil increases. This cinching mars the surface. Therefore, a guide must be provided for laying down the successive turns of the coil in order to avoid surface marring while accommodating the varying tensions.

As the coil is being wound, it is most convenient and least costly if it can be wound upon an inexpensive plastic hub or former. However, if the web is metal, it might apply a relatively severe stress upon the plastic of the former (especially in the hub region) because there is a substantial tension in the web. Moreover, the plastic is likely to have a substantial dimensioned change as it shrinks during curing. Therefore, if the hub of the former and its spindle simply have a square cross section, the hole in the former may not always fit over the spindle on which it is mounted. If it does not fit well, it may wear into a rounded shape and no longer be operative throughout its entire lifetime. The problem is severe since the metal web is much harder than the plastic former and, therefore, may tend to cut into it.

It might or might not be easy to solve the problem in conventional ways, as by molding a metal insert in the former, for example, but that increases costs. If various splines or keys are formed on the spindle and are molded into the plastic, they may wear and become rounded. Also, the need to fit the former on the spindle lead to expensive, time consuming, labor intensive procedures for loading the former onto the spindle.

Accordingly, an object of the invention is to provide new and improved means for and methods of locking a former onto a metal spindle. Here, an object is to provide means for maintaining a very tight fit between a spindle and a former, despite inherent variations in the dimensions of holes in the various former that may be used.

Another object of the invention is to provide a hub lock for a plastic former.

In keeping with an aspect of the invention, these and other objects are accomplished by interposing a rubber or similar elastomer block between a metal spindle and a square hole formed in the wheel-like plastic former. A hydraulic ram is arranged to squeeze the rubber block between two plates which are pulled toward the opposite sides of the former wheel. These plates are perpendicular to the axis of the hole, thereby causing the block to expand radially and seize the interior of the hole in the plastic former. The elasticity of the rubber block causes it to custom form itself to fit the square hole perfectly. If there is any unevenness of winding which tends to jerk the spindle against the former, the elasticity of the block acts as a shock absorber to reduce the stress upon the hole in the former.

A preferred embodiment of the invention is shown in the attached drawings, wherein.

Figure 3:
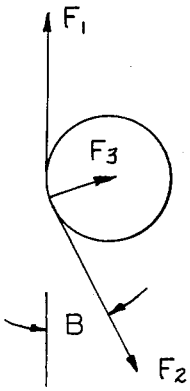
Figure 4:
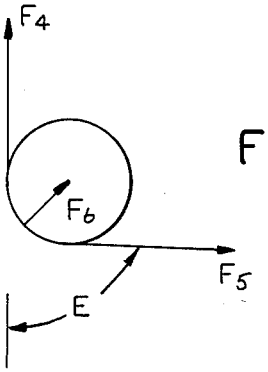
Figure 5:
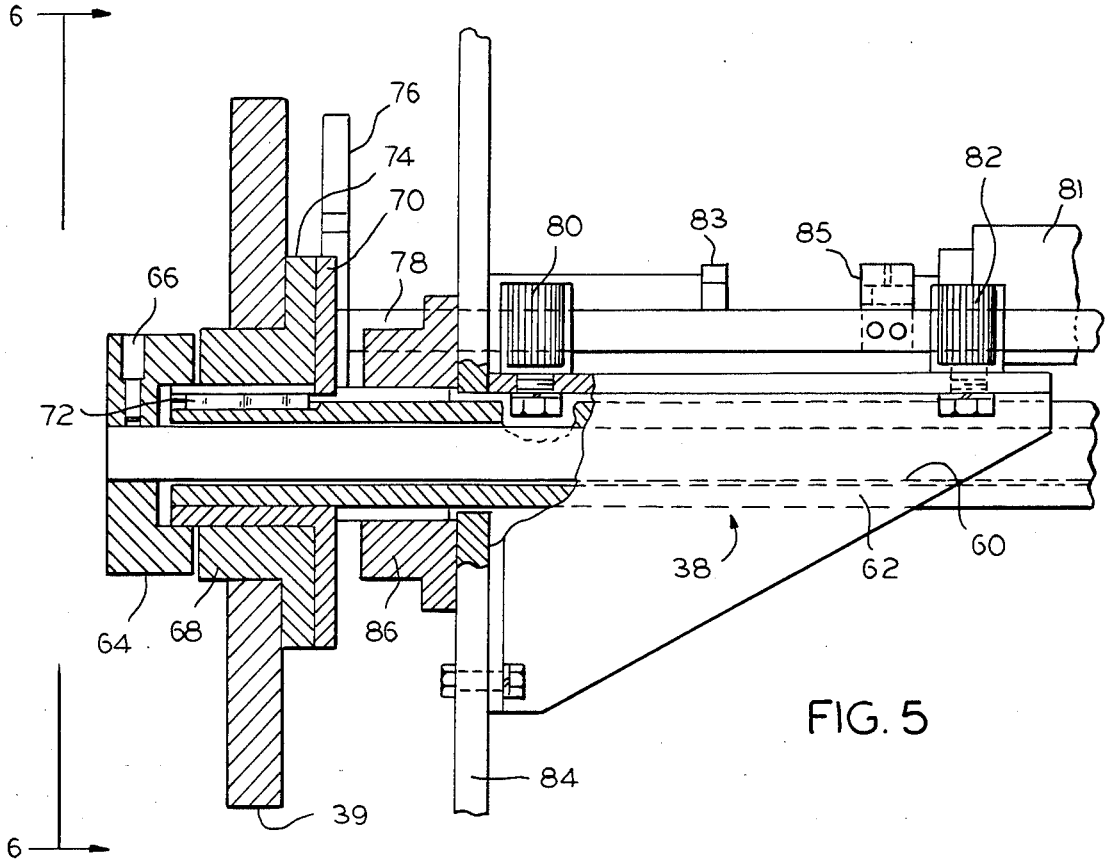
Figure 6:
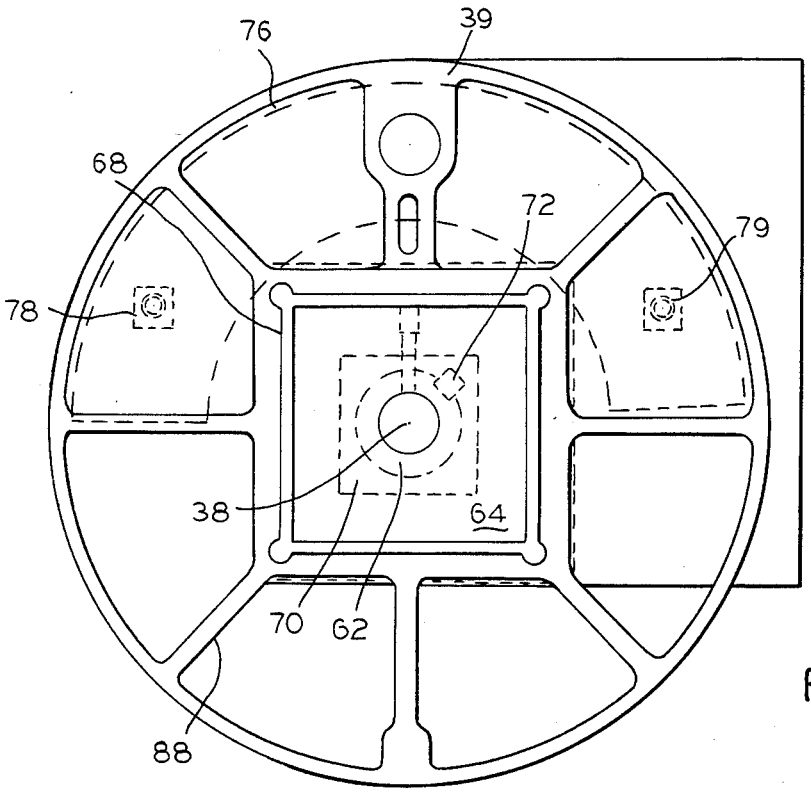

FIG. 3 graphically shows a force diagram which positions a floating guide roller at the start of a coil winding operation;

FIG. 4 is a similar force diagram showing how the guide roller is positioned at the end of a coil winding operation;

FIG. 5 shows, partially in cross section, the inventive hub lock assembly used in the machine of FIGS. 1–5; and FIG. 6 is an end elevation view taken along line 6—6 of FIG. 5 which shows the former locked into position on the spindle.

Figure 1:
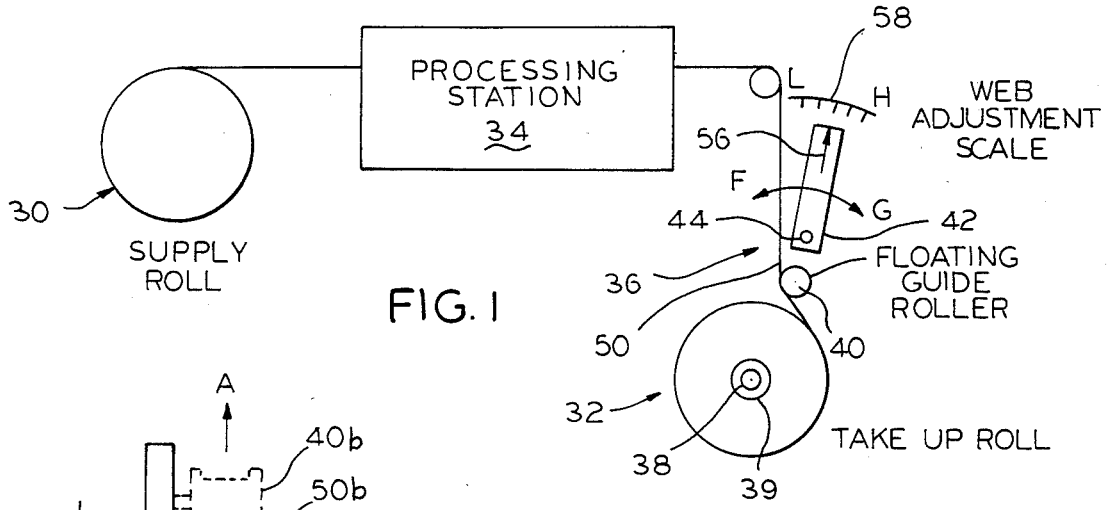
FIG. 1 is a schematic view of a coil winding and rewinding system with a guide roller being held in place near, but not touching, the circumference of the coil.

The metal coating and coiling system of FIG. 1 includes a supply roll 30, a take-up roll 32, a metal coating processing station 34, and the inventive floating guide roller and its support system 36. The supply roll 30, symbolically represents any suitable source of stock material. Here, it is assumed to be a metallic web or ribbon-like material which has previously been wound into a supply roll. It could also be the output of a metal rolling mill, or any other suitable supply. In the example of venetian blind slat stock, supply roll 30 would be a spool of a thin aluminum ribbon which is about an inch or two wide and a few mils thick.

The processing station 34 supplies any suitable surface coating to the web of metal stock, as it is pulled from the supply roll 30. In the example of a venetian blind slat, station 34 supplies a coat of enamel or lacquer which completely covers and encases the aluminum ribbon. The take-up roll 32 is a coil which is being wound on a spindle 38, having a hub former 39 mounted thereon. The coil 32 may have any suitable beginning diameter which may be as small as the diameter of spindle 38 or former 39 mounted on the spindle. The ending and ultimate diameter of the coil may be quite large, by comparison.

A floating guide roller 40 always remains near, but not touching, the growing outside diameter or circumferential perimeter of the coil, being formed on the take-up roll 32. This roller aligns the successive turns of the web of metal ribbon as they are being laid down on the coil.

Figure 2:
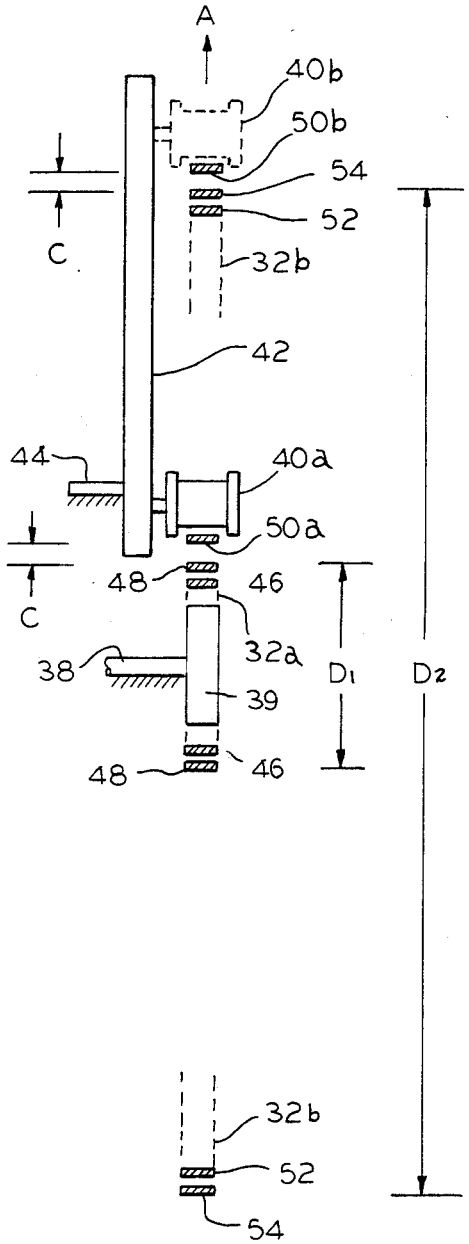
FIG. 2 is a side elevation view of a floating guide roller and associated portions of the structure of FIG. 1.

Briefly, the guide roller 40 is mounted on a lever or arm 42 which is pivotly connected at point 44 to any suitable support frame (not shown). The lever or arm 42 sits on one side of the take-up roll 32 so that the expanding coil may grow in front of the arm, as shown in FIG. 2.

In greater detail, the guide roller 40 is shown in solid lines near the lower end of arm 42, at the beginning of a coil formation. The starting diameter coil D1 is not much larger than the diameter of a core or former 39 mounted on spindle 38. The last two circumferential peripheral turns of the small diameter starting coil 32*a* are shown at 46, 48. The coated web 50 is here shown as being guided by the floating roller in position 40*a* so that each succeeding turn is correctly aligned, as turns 46, 48 are here shown to be aligned.

The web 50*a* passing under the guide roller in position 40*a* is separated from the outer turn 48 of the beginning coil 32*a* by a clearance distance C. There, roller 40*a* is close enough to insure alignment of the successive turns, but far enough to prevent the web 50 from touching outer turn 48. As the coil 32 grows its diameter continuously becomes larger, until it reaches some maximum D2, as shown at 32*b*. Here, the outer two circumferential peripheral turns of the large diameter ending core are numbered 52, 54. The original, relatively small beginning diameter D1 (shown in FIG. 2) of coil 32*a* has grown to become a relatively large ending diameter D2 of coil 32*b*. In one example, beginning diameter D1 is about four inches and ending diameter D2 is about forty inches.

As the diameter of coil 32 increases, a mounting for the guide roller 40 slides up (direction A) the lever or arm 42 to the position 40*b*, shown by dashed lines. At each instantaneous position along the length of lever or arm 42, the clearance space C remains substantially the same, as here shown between the running web 50 and the outermost turn 48 or 54.

The instantaneous position of the support for the guide roller 40 (and therefore the clearance space C) is determined by the resultant of the various vector forces acting on it. FIG. 3 illustrates three forces F1, F2 and F3, which occur at the small diameter beginning coil. Force F1 represents the total tension in the incoming web 50 before it reaches roller 40. Force F2 represents the total tension in the outgoing web after it leaves roller 40 and before it reaches the coil 32. Force F3 is the resultant force acting on roller 40. The angle B is the angle of the outoing (force F2) with respect to the incoming web (force F1). Thus, angle B is set by the relatively small diameter D1 (FIG. 2) of the beginning coil, at the start of winding. Angle B is in the order of 15° to 20° in one exemplary system. Or, stated another way, the incoming and outgoing web stock almost form a straight line.

In the large diameter ending coil (FIG. 4), force F4 represents the tension in the incoming web. Force F5 is the tension in the outgoing web. Force F6 is the resultant force acting on the guide roller 40. The relatively large angle E (FIG. 4) is the angle of the outgoing web relative to the incoming web (force F4). The angle E may be in the order of 75°–80°. Or, stated another way, the angle between the incoming and outgoing web stock approaches a right angle. This change between the beginning and ending angles B and E occurs because the diameter of the coil grows larger. The change in angle causes the floating guide roller 40 to move in direction A, along the lever or arm 42. Thus, the guide roller 40 assumes a position which is dictated by the force vectors acting upon it and by the web angle extending from the guide roller to the coil surface.

The forces acting on the roller also change as a function of the strength of the material forming web 50. The above cited example of venetian blind slat stock may be relatively lighweight aluminum with a low resistance to bending. Or, it could be another and relatively heavy material, such as stainless steel stock with a high resistance to bending. Therefore, the angles B and E between the web and a tangent to the circumference of the coil surface change as a function of the web material.

Accordingly, when the coil winding machine is originally set up, the position of the lever or arm 42 is moved about pivot point 44 in the directions F, G to a selected position between limits marked "L" and "H" ("Light" and "Heavy") in FIG. 1. A pointer 56 on the arm 42 may be set to any indication enscribed on a scale 58. Conveniently, the scale might be marked in the physical terms of the stock, as for example, "1 AL 64", meaning aluminum which is one inch wide and 1/64-inch thick.

Once the position of lever or arm 42 is set and locked, the guide roller 40 automatically follows the expanding diameter of coil 32 as it is wound.

The actual structure of the invention seen in FIGS. 5 and 6, where the same reference numerals are used to identify the parts which have already been described.

The spindle 38 is a concentric pair of shafts with a solid inner shaft 60 telescoping within an outer tube 62. The outer tube 62 does not have any lateral motion, but it and shaft 60 rotate as a unit. A hydraulic ram (not shown) is provided for sliding the shaft 60 through tube 62 to place the hub in a locked position or for extending shaft 60 through tube 62, to place the hub in an unlocked position.

Attached to the outer end of shaft 60 is a pressure plate 64, held in place by a set screw 66. This plate 64 applies pressure to an elastomer or rubber block 68 when the shaft 60 is retracted, and it relaxes the block 68 when the shaft is extended.

The block 68 is a midrange material which can conform to shape and yet which is not so flexible that the coil will fail to run smoothly without wobble. In one embodiment, the block 68 was a black urethene having a 50–55 duro-meter reading.

A metal part 70, somewhat in the shape of a top hat, slides over the end of the tube 62, where it is held in place by a key 72. Part 70 and shaft 32 rotate as a unit. The elastomer or rubber block 68 fits over and rests on the crown of the top hat shaped part 70. Thus, the elastomer or rubber block 68 is captured between a pair of flanges which are parallel to the sides of the wheel-like former 39 and perpendicular to the axis of the shaft 62. One of these flanges is the pressure plate 64 and the other is the flange which forms the brim of the top hat shaped part 70.

When shaft 60 pulls pressure plate 64, the elastomer or rubber block 68 is squeezed between it and the flange forming the brim of the hat. Since the block is squeezed in its horizontal dimension (as viewed in FIG. 5), the rubber expands in the vertical dimension and is pressed against the inside of the center hole in former 39.

The plastic former 39 may have any of several sizes and thicknesses. However, for mechanical purposes, it should always be centered upon the same radial center line, regardless of its thickness. Therefore, a spacer plate 74 is here shown as adding a sufficient thickness to former 39 in order to place its center line in a correct winding position. If a thicker former is used, spacer plate 74 may be eliminated.

Behind the top hat shaped part 70 is a semi-circular, arcuate knock off plate 76 which slides out and against former 39 to push the finished coil off the end of the spindle assembly 38. The knock-off plate 76 is pushed by two sliding rods 78, 79 (FIG. 6). The guide rails 78, 79 and linear bearings 80, 82 may be a product sold under the trademark "NYGLIDE" by Precision Laminations, a company located in Rockford, Ill. In this form, the linear bearings have steel guide rails 78, 79 with square or rectangular cross section (FIG. 6) and nylon bearing blocks, each having therein a window with a cross section corresponding to the cross section of the rails 78, 79. This form of bearing has an extremely low sliding friction.

Rods 78, 79 slide in linear bearings 80, 82, and are manipulated by a hydraulic ram 81. An adjustable bolt 83 and block 85 form a limit stop which fixes the stroke length for the ram 81 and, therefore, the knock-out 76.

The spindle assembly 32 is rotatably supported by two flange bearings attached to a main frame 84. One of these bearings is shown at 86.

The end view of the assembly (FIG. 6) has the same reference numerals which are used to identify the same parts that are seen in FIG. 5. The former 39 is a wheel-like plastic disc with surface recesses formed therein to provide a number of spoke-like sections, one of which is seen at 88. These surface recesses save plastic and reduce the shrinkage problems, which may occur when the plastic form 32 cools and cures, after it is molded.

In operation, any spacer plates 74 that are required, may be installed over the rubber block 68 and placed against its internal compressing flange in order to position the center of the former 39 on a correct radial center line of the spindle assembly 38. Then, a hole H1 in the hub of the former 39 is placed over the rubber block. A hydraulic ram is operated to pull shaft 60, and, therefore, pressure plate 66, and squeeze the rubber block 68 between pressure plate 64 and the brim flange of the top hat shaped part 70.

The web 50 is brought in, fed under the guide roller in position 40*a*, and the end of the web is taped to the former 39 or inserted into a slot in the former. Then, the former 39 is driven by shaft 62 and rotated several times so that the web takes a few turns to lock itself into position and form the beginning coil.

A motor is energized and the coil is wound. The guide roller 40 guides and directs the web into tangential alignment with the circumference of the coil. The guide roller raises automatically as the coil diameter increases, thereby maintaining the tangential alignment throughout the winding. After the coil is completed, the machine stops and a hydraulic ram (not shown) is operated to extend shaft 60 and move pressure plate 64 away from rubber block 68, thus allowing it to relax.

Then, hydraulic ram 81 is operated to slide rods 78, 79 and push the knock-off plate 76 against the coil former 39. This removes the completed coil from the machine.

Those who are skilled in the art will readily perceive how to modify the invention. Therefore, the appended claims are to be construed to cover all equivalent structures which fall within the true scope and spirit of the invention.

The claimed invention is:

1. A hub lock comprising a rotatable drive spindle means having a metal tube with a telescoping metal shaft slidably positioned therein, the tube and shaft turning as a unit, a pressure plate positioned on and attached to the end of said sliding shaft, a flange positioned on and attached to said tube, a resilient elastomer block positioned between said pressure plate and said flange to be squeezed therebetween when said shaft is retracted and to be relaxed when said shaft is extended, a plastic wheel-like former having a central mounting hole, the internal cross section of said hole and the external cross section of said elastomer block having complementary substantially polygonal cross sections, whereby said hole fits over said elastomer block, said block being tightly forced against the interior wall of said center hole when block is squeezed for resiliently transmitting a driving force from said rotatable spindle and said polygonal elastomer block to said former while protecting the plastic from damage by said metal.

2. The hub lock of claim 1 and knock-off plate means positioned adjacent said spindle and being movable in a direction perpendicular to the side of said former to push said former off said shaft.

3. The hub lock of claim 1 wherein said elastomer block is urethene having a duro-meter hardness in the range of substantially 50–55.

4. The hub lock of claim 1 and spacer means for centering said former on said elastomer block.

5. A hub lock for a coil winder comprising means for winding a relatively narrow ribbon-like web into a very large diameter coil on a flangeless coil former, whereby said coil is very narrow and grows from a relatively small diameter beginning coil to said relatively large diameter ending coil, and further where the flatness and integrity of said coil depends upon how well each turn is centered on the perimeter of the growing coil, said coil former comprising a relatively soft plastic wheel-like member having a generally square hole in the middle thereof, said winding means comprising at least a relatively hard telescoping rotatable shaft for receiving and supporting the hole in said wheel like-member whereby said relatively hard shaft turns said relatively soft former to wind up said coil, a resilient elastomer block interposed between said shaft and the inside perimeter of said hole for resiliently transmitting a driving force from a rotation of said telescoping shaft while protecting said relatively soft former from being damaged by said relatively hard shaft, a pair of flange means mounted on said shaft perpendicular to an axis of said hole, said flanges being positioned on opposite sides of said hole, means for squeezing said elastomer block by telescoping said tube to pull together said flanges and thereby squeezing said block along the axis of said hole to expand and press the block against the inside perimeter of the hole.

6. The hub lock of claim 5 wherein said elastomer block is urethene having a duro-meter hardness in the range of substantially 50–55.

7. The hub lock of claim 6 wherein said means for winding a coil comprises an assembly of a shaft which is concentrically and slidably mounted inside an elongated tube, said shaft and tube rotating as a unit, one of said flanges comprising a pressure plate attached to said shaft, the other of said flanges being a member generally having a somewhat top hat shape with said resilient block mounted on the crown of said top hat shape and said brim of said top hat shape forming the other of said squeezing flanges.

* * * * *